US005342116A

United States Patent [19]

Walton

[11] Patent Number: 5,342,116

[45] Date of Patent: Aug. 30, 1994

[54] PROGRAMMER'S ANTI-SLUMP CHAIR WITH KNEE SUPPORT

[76] Inventor: Charles A. Walton, 19115 Overlook Rd., Los Gatos, Calif. 95030

[21] Appl. No.: 954,569

[22] Filed: Sep. 30, 1992

[51] Int. Cl.[5] ..... A47C 31/00

[52] U.S. Cl. ..... 297/466; 297/423.12

[58] Field of Search ..... 297/423, 427, 429, 406, 297/423.1, 423.12, 423.17, 423.19

[56] References Cited

U.S. PATENT DOCUMENTS

| | | | |
|---|---|---|---|
| 1,885,750 | 11/1932 | Miller | 297/427 X |
| 2,407,646 | 9/1946 | Best | 297/423 |
| 2,467,252 | 4/1949 | Brandon | 297/423 X |
| 2,585,398 | 2/1952 | McIlwraith | 297/427 X |
| 3,761,129 | 9/1973 | Schultz | 297/429 X |
| 4,190,287 | 2/1980 | Lemisch et al. | 297/466 |
| 4,192,546 | 3/1980 | Smith | 297/427 X |
| 4,247,064 | 1/1981 | Schulman et al. | 297/466 X |
| 4,506,930 | 3/1985 | Lambert | 297/423 |
| 4,623,194 | 11/1986 | Pillot | 297/429 X |
| 4,765,684 | 8/1988 | Kvalbein et al. | 297/429 |
| 4,767,159 | 8/1988 | Opsvic | 297/423 |
| 4,767,160 | 8/1988 | Mengshoel et al. | 297/423 |
| 4,773,106 | 9/1988 | Toso et al. | 5/432 |
| 4,819,988 | 4/1989 | Hellstrom | 297/427 X |
| 4,843,999 | 7/1989 | Kobus et al. | 114/363 |
| 5,001,791 | 3/1988 | Toso et al. | 5/432 |
| 5,040,522 | 8/1991 | Daniels | 297/466 X |
| 5,054,852 | 10/1991 | Tholkes | 297/423 X |
| 5,083,554 | 1/1992 | Toso | 128/78 |

FOREIGN PATENT DOCUMENTS

| | | | |
|---|---|---|---|
| 969883 | 12/1950 | France | 297/466 |

*Primary Examiner*—Peter M. Cuomo
*Assistant Examiner*—Jerry Redman
*Attorney, Agent, or Firm*—Robert Charles Hill

[57] ABSTRACT

A chair having a pair of restraints against a sitting user's knees. Each restraint is a J shaped bar having an end that curves around in front of the chair, such that the user may sit with each knee in the space between the curved end of the restraint and the front of the chair and the back supported against the back of the chair. The device thereby maintains the lower end of the spine in an erect position. The restraints are adjustable to accommodate various sizes of the users. The restraints are spring loaded for additional comfort to the user. In another embodiment, the seat includes a seat hingeably supported on a base such that, in one version, the seat moves forward to provide additional support when the user sits down. In another version, the restraints are pulled back against the knees when the user sits down.

20 Claims, 4 Drawing Sheets

FIG._1
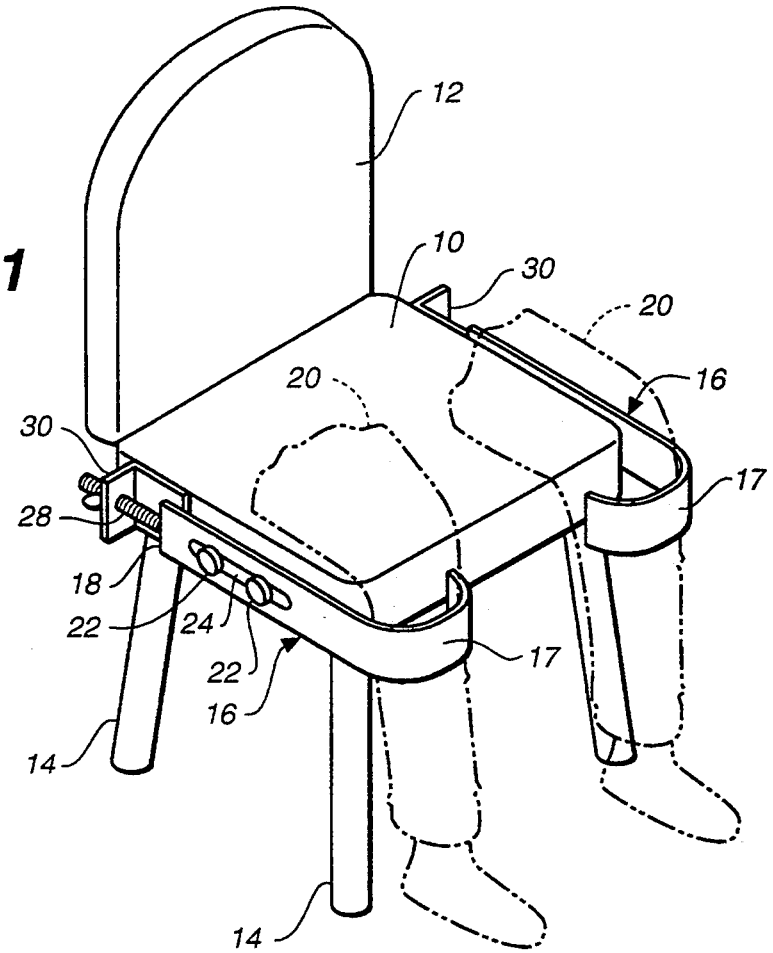
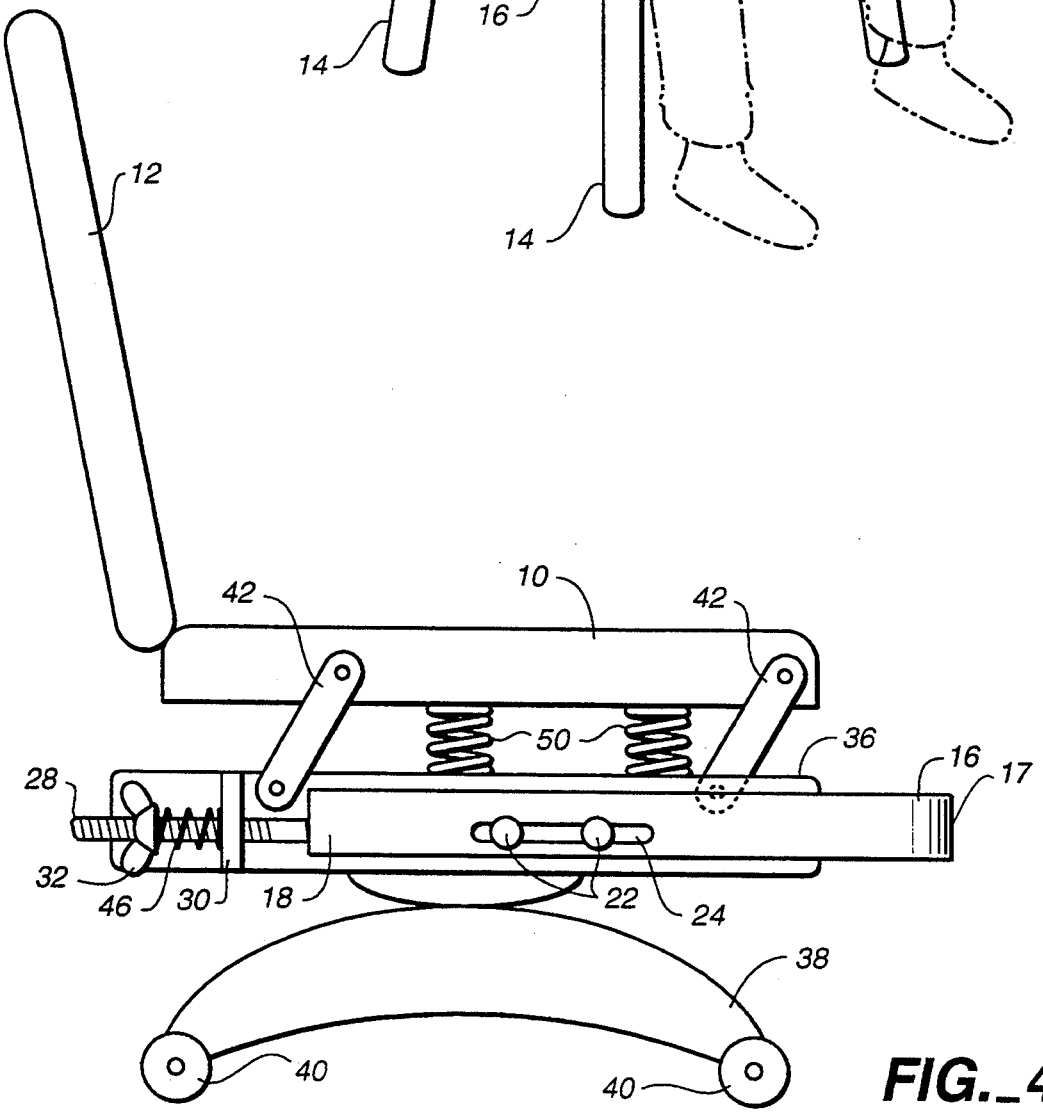
FIG._4

PROGRAMMER'S ANTI-SLUMP CHAIR WITH KNEE SUPPORT

FIELD OF THE INVENTION

This invention relates to a chair to be used by workers such as programmers who spend long periods of time in chairs and particularly to a chair that provides knee restraints together with lower back restraint that relieve strain on the back.

BACKGROUND

Many occupations require sitting in a chair for lengthy periods. One example is programming; other examples are business-related uses such as typing, bookkeeping or using workstations. For comfortable sitting for lengthy periods, it is desirable that the spine be comfortably restrained in a substantially vertical position. If the spine is not restrained, the body tends to slump forward with the back assuming a convex shape, which is tiring and harmful to the spinal disks and breathing function and which creates a poor appearance. Slump can be overcome by voluntarily straightening the back by contraction of the back muscles so that the back is more vertical. Such voluntary contraction puts extra pressure on the spinal disks, and the constant tension in the muscles required to maintain this posture causes fatigue.

A chair back can provide resistance to the tendency of the back to slump or bend forward, i.e., to bulge on the dorsal side. However, a chair back forces the occupant forward. This force must be counteracted by the frictional restraint of the user's buttocks against the chair seat. This frictional restraint requires sustained application of force and causes wrinkling of the trousers or skirt and overheating of the worker on hot days.

The patent literature discloses devices intended to help the occupant maintain correct posture in a chair.

For example, U.S. Pat. No. 4,190,287 to Lemisch discloses a "knee abductor" system which is intended for invalids and people in wheelchairs. It holds the knees apart while retaining some freedom. To enter, the user first unhooks and then re-hooks straps on two sides. The device is not convenient for office use where frequent entry and re-entry is usually necessary.

U.S. Pat. No. 4,773,106 to Toso and Specter for a Back Support, U.S. Pat. No. 5,001,791 to Toso for Back Support with Integral Carrying Case, U.S. Pat. No. 5,083,554 to Toso, all show an assembly with no chair. This assembly has the advantage of portability but it has the disadvantage of having to be carried from place to place, it must be unhooked when a person leaves the work area and must be reinstalled when the user returns.

The present invention avoids these shortcomings by building the knee support and back support into one assembly which is ready for the user when he returns and may be quickly entered and exited conveniently in a natural flowing movement.

U.S. Pat. No. 4,765,684 to Kvalbeim discloses a foldable adjustable knee rest. The knee rest is below seat level and therefore part of the body weight is supported by the knees leading to a substantial and tiring constant pressure on the knees. The forward tilt of the seat takes the back away from the back rest of the chair with a consequent loss of important support to the small of the back. The lower torso is not tucked between supporting chair members as is the case in the present invention.

The knee support mechanism requires additional structure attached to the central support under the seat of the chair adding to the expense of manufacturing the chair.

U.S. Pat. No. 4,767,159 to Opavic discloses a chair with support for the shins. The shin rest is below the seat level.

U.S. Pat. No. 4,767,160 to Mengshoel et al discloses a chair for kneeling in which the knee rest is also below the seat level. Both of these Patents have the same drawbacks discussed above.

U.S. Pat. No. 4,843,999 to Kobus discloses a boat seat suitable for paddling but not suitable for office use.

SUMMARY

It is therefore an object of this invention to provide a device that relieves the stress on the back and buttocks when the user is sitting in a chair to which the device has been attached. This is accomplished in embodiments in this invention by a knee support which restrains the buttocks from sliding forward and maintains the user's back against the back of the chair.

It is a further object that the chair be totally dedicated to supporting the user in the manner prescribed which includes permitting the user to sit down or stand up and walk away from the chair without the inconvenience of having to attach or detach himself as required with the use of straps as practiced with devices of the prior art. This is accomplished by a pair of restraints, each restraint having a bowed end that curves around the front of the knee without completely capturing the knee. Each restraint is shaped so as to prevent the knee from accidentally slipping out of the respective restraint, but simultaneously permitting the user to disengage himself from the device when he desires.

Another object is to provide a knee restraint that permits some degree of motion of the user without sacrificing required support. This is accomplished by securing an end of the restraint by one of several spring loaded securing means including constructions that permit adjusting the force of the bow shaped end of the restraint against the knees. This object is also accomplished in other embodiments by a lever construction that transforms the downward weight of the body as the user sits down into a force exerted by the knee restraint against the knee.

BRIEF DESCRIPTION OF THE FIGURES

FIG. 1 shows a perspective view of one embodiment of the chair with knee restraints of this invention and shows the legs of the user with torso cutaway.

FIG. 4 shows a chair in which force from the body weight is applied to the knee restraint when the user sits down in the chair.

DESCRIPTION OF THE BEST MODE

Figure 2:
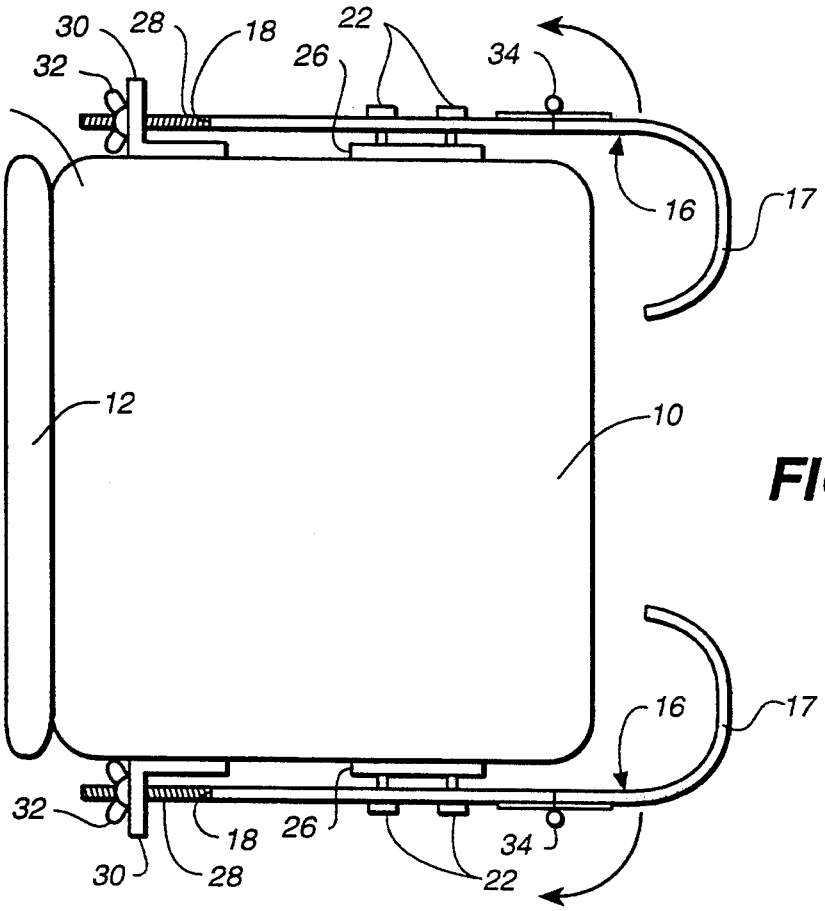
FIG. 2 shows a top view of FIG. 1.

Turning now to a discussion of the drawings, FIG. 1 is a perspective view of the chair of this invention. There is shown a seat 10, back 12, and legs 14.

Attached to the sides of the seat are right and left restraint bars 16. The restraint bars 16 are preferably rigid metal straps that have a bow shaped end 17 in a "J" configuration. The bow shaped ends 17 engage the front of the legs 20 of the user just below the knee. The area of bow shaped ends 17 of the restraints 16 which contacts the knees are well padded in order to be comfortable against the knee.

The knee restraint bars 16 restrain the legs 20 so as to force the back of the user toward the back 12 of the chair so that the back of the chair 12 can provide support to the lower end of the user's spine. The user is supported in place with his spine comfortably erect without the constant muscle tension that would otherwise be required. Therefore, the user can occupy the chair for lengthy periods with greatly reduced stress. It is important that the principle point of support for the back be low, in the region of the sacrum, and fourth and fifth lumbar vertebrae. When seated, the user is tucked in between between the seat back and the knee restraints. The effect is very comfortable.

FIG. 2 is a top view showing the restraint bars 16 slideably mounted on pins 22 through slots 24 (FIG. 1). The pins 22 extend from plate 26 attached to the side of the seat 10. The ends 18 of the restraint bars 16 are secured to the ends of threaded rods 28 which extend through angle brackets 30 where they are secured by wing nuts 32.

The first time a user sits in the chair, the restraint bars 16 are loose allowing them to be positioned for convenient entry of the user to the sitting position. Then the restraint bars 16 are adjusted to a position to accommodate a user's size by turning the wing nuts 32. The knee restraint bars 16 have thus been adjusted to accommodate the individual size of the user.

When entering the chair, the person slips first one leg then the other in between the respective bow shaped end of the knee restraint bar and seat. Then he sits. In the process of sitting, his knees slide forward to engage the bow shaped ends 17 while, at the same time, the lower end of the spine is supported by the back of the chair.

Other embodiments of this invention are contemplated, each of which have an application in particular situations.

Figure 3:
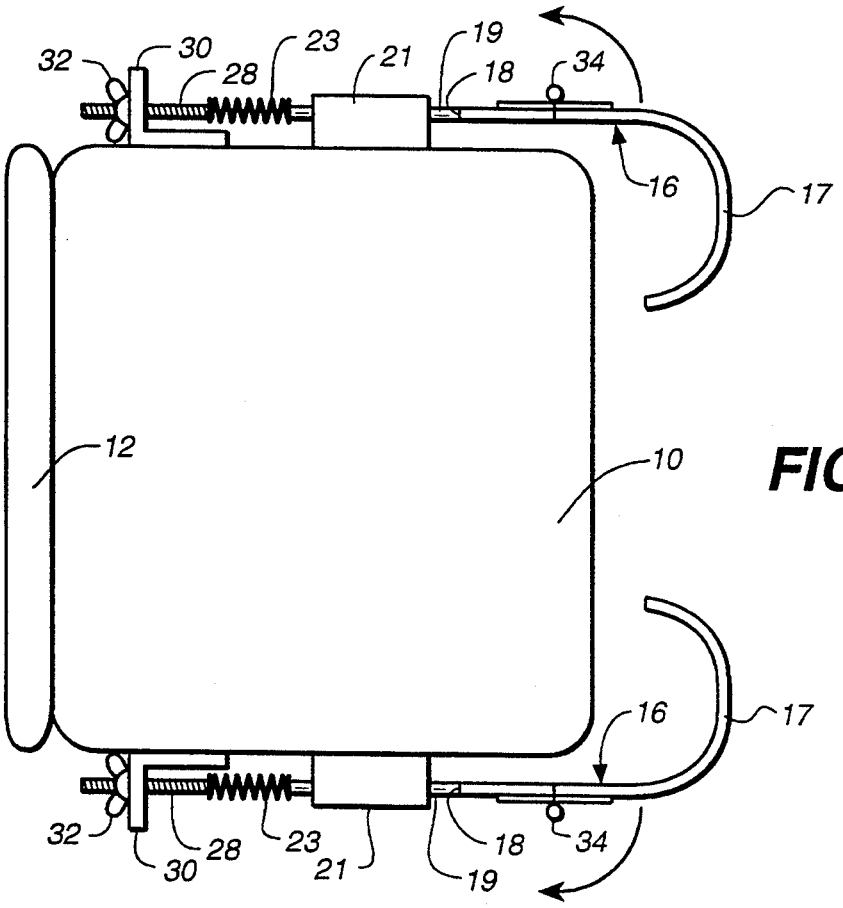
FIG. 3 shows a top view of a modification of FIG. 2.

FIG. 3 is a modification of FIG. 2 which provides for resiliency or elasticity in the knee restraint bar 16 which is desirable for some users in order to allow for minor changes in positions and motion of the body. The ends 18 of the restraint bars 16 are each attached to rod sections 19 which are slideably supported in sleeves 21 secured to the seat 10. The other ends of rods 19 are secured to ends of springs 23 respectively whose other ends are attached to threaded sections 28. When the wing nuts 32 are tightened, the springs 19 are tightened and mild pressure is applied to the knees. Body and thigh motion of a limited amount is still allowed owing to the variable spring extension. Therefore, the spring reduces rigidity by providing some give and take during motion and avoids excessive application of pressure. The construction of FIG. 3 also allows the knee restraints bars 16 to rotate along their respective long axis by (about) plus or minus 45 degrees. This allows rotation of the lower leg and foot such as would occur when the seated user is moving the chair with his legs.

In another modification also shown in FIGS. 2 and 3, each restraint bar 16 has a hinge 34 permitting the user to swing the bow shaped end 17 of restraint bar 16 outward (see arrows) in order to facilitate the sitting operation. The hinges 34 may also be constructed to allow the bow shaped end sections to swing in the opposite direction shown if it is desired to fold the bow shaped restraint bars under the chair when not in use.

FIG. 4 shows adaptation to the type of chair that is used in offices and comprises a seat 10 mounted on a base 36 supported on the well known swivel support 38 provided with rollers 40. This arrangement allows convenient rotation left or fight and tilting backward and forward as well as easy rolling on the floor. FIG. 4 also shows an embodiment in which the seat 10 is hingeably attached to the base 36 by hinge brackets 42. The seat 10 is biased away from the base 36 by seat springs 50 until the user sits on the seat. The restraint bars 16 are spring loaded toward the base 36 by restraint springs 46. When the user sits in the seat 10, the seat 10 pivots on hinge brackets 42 forcing the knees against the bow shaped restraint ends 17.

Restraint springs 46 cushion the force of the knees against the bow shaped restraint ends 17.

Figure 5:
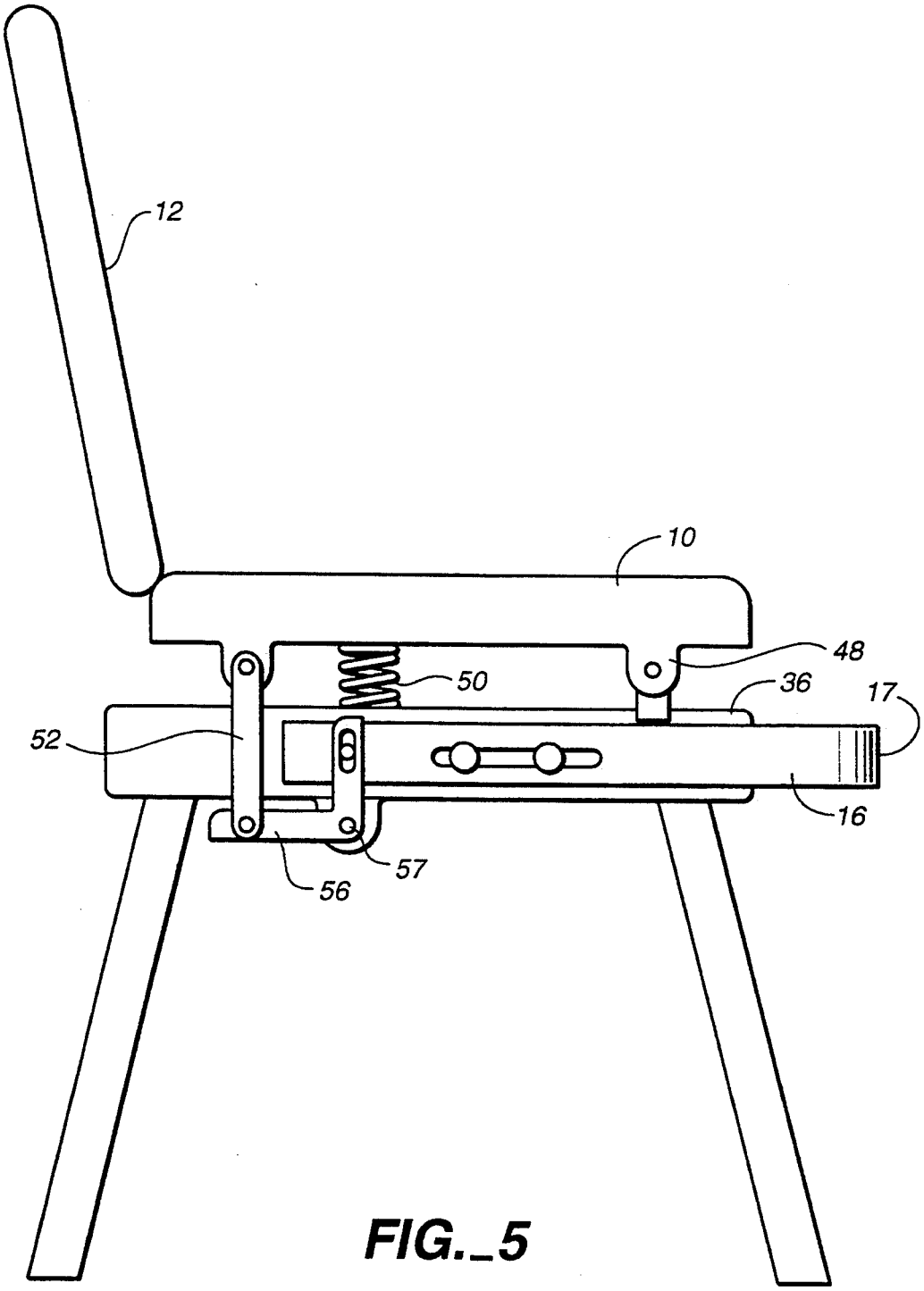
FIG. 5 shows another embodiment for applying force from the knee restraints when the user sits in the chair.

FIG. 5 is another arrangement in which the bow shaped restraint ends 17 are pulled against the knees when the user sits down. The seat 10 is shown hinged to the base 36 by hinge 48. Seat spring 50 biases the seat away from the base 36. A link 52 joins the seat 10 to one arm of crank 56 pivotally attached at location 57 to base 36. The second arm of crank 56 is engaged with restraint bar 16. When the user sits down, the seat 10 rotates about location 48 thereby pulling the bow shaped end 17 back against the knee.

Only one side of the seat is shown in FIGS. 4 and 5 but a mirror construction is formed on the unseen side of the seat.

Figure 6:
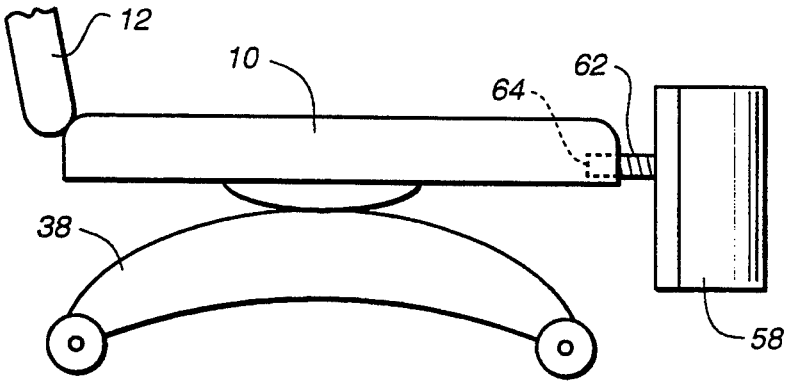
FIG. 6 shows a side elevational view of a knee restraint attached to the front seat edge.
Figure 7:
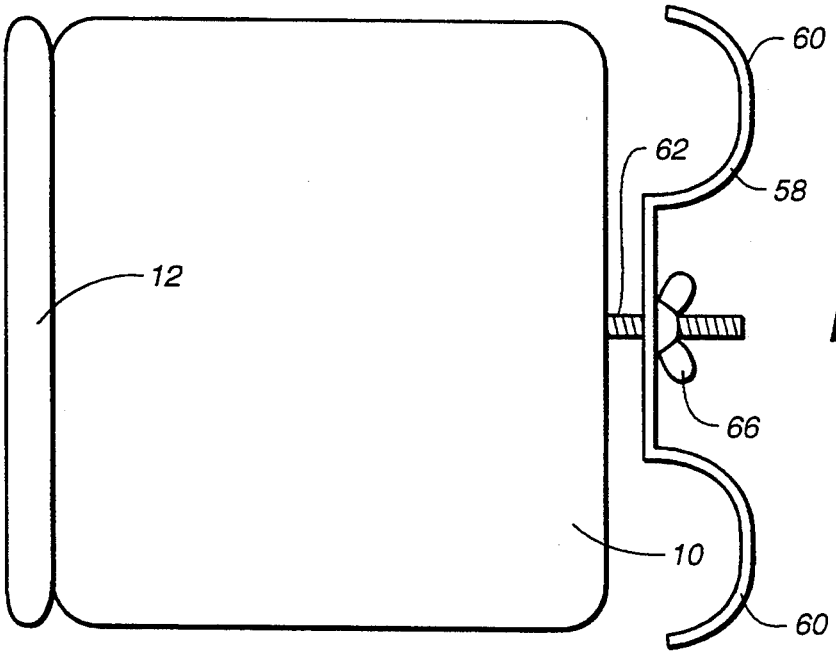
FIG. 7 is a top view of FIG. 6.

FIGS. 6 and 7 show respectively the elevational and top views of an embodiment in which one cross member 58 extends across the front edge of the seat 10 and is configured on opposite ends 60 to restrain both knees. The cross member is supported and adjustably spaced from seat 10 by a central support member 62 which has one end 64 secured on the front edge of the seat 10 and another end 66, which is threaded, passing through a hole (not shown) in cross member 58. Space between cross member 58 and seat 10 is adjusted according to the desires of the user by wing nut 66.

Figure 8:
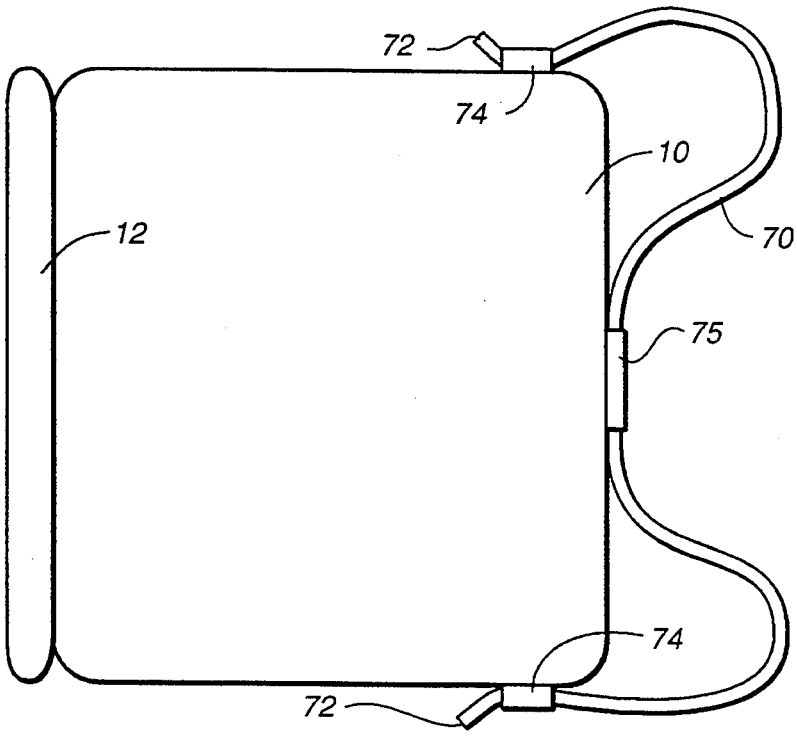
FIG. 8 is a top view of a seat with strap restraint.

A variation of the embodiment shown in FIGS. 6 and 7 is shown in FIG. 8 where the cross member 70 is a flexible strap secured at the center 75 of the edge of the seat 10. The strap is made of an appropriate material such as leather or plastic. Opposite ends 72 of the strap 70 are secured to the edges of seat 10 by an adjustable attachment means 74 such as a buckle or hook. Particularly appropriate for attachment is the self-clamping type of buckle, or velcro.

Figure 9:
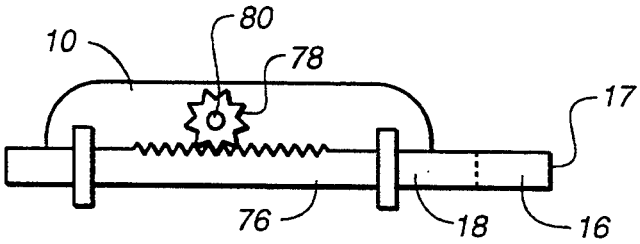
FIG. 9 is a side view of a ratchet and pinion gear configuration.

FIG. 9 shows an arrangement wherein a rack gear 76 is attached to the end 18 of the restraint bar 16 (cutaway) and is coupled to a pinion gear 78 secured to the seat 10 in place of the wingnut and threaded end discussed above. The rack gear 76 and restraint bar 16 are adjusted by turning knob 80 which is easily accessible to the user. (Most of seat 10 is cutaway in FIG. 8.) Not shown is the opportunity to motorize either the pinion 78 of FIG. 9 or the wing nuts 32 of FIGS. 2 and 3.

Other modifications could be made within the scope of the invention which is accordingly defined only by the following claims which are further exemplary of the invention.

What is claimed is:

1. A device for prevention of slumping by a user, said user having a back and knees and sitting in a chair having a back and a seat having a back edge supporting said chair back, a front edge adjacent to knees of said user and two side edges, said device comprising:

a pair of restraint means, each having a secured end and a bow shaped end for engaging a front of one of said user's knees; said secured ends adjustably secured to said side edges of said seat;

support means for adjustably securing said secured ends of one of said brace means to said chair seat;

each said support means having means for mounting said respective restraint means to slide parallel and in proximity to a respective one of said side edges of said chair; and each said restraint means and said respective securing means constructed in operable combination with one another to provide that a user sitting in said chair with the knees restrained by said restraint means be permitted to restrain the knees by adjusting said support means to move said restraint means to a location where said user's back is supported against said back of said chair thereby preventing slump.

2. A device as in claim 1 wherein said secured ends are joined and adjustably secured to said front edge of said seat, said front edge having a center.

3. A device as in claim 2 wherein said support means are mounted at the center of said front edge of said seat, and adjustably allow front and back travel of said support means and said restraint means.

4. A device as in claim 1 wherein said bow shaped ends are padded.

5. A device as in claim 1 wherein each said slideably supporting means comprises:

an elongated slot in said respective restraint means and intermediate said secured end and said bow shaped end;

a plate attachable to an edge of said chair seat with a plurality of pins, each pin having an end attached to said plate and extending substantially perpendicularly away from said plate and protruding through said slot.

6. A device as in claim 1 wherein said mounting means comprises an elongated sleeve secured on and parallel to a respective one of said side edges of said seat with said respective restraint means slideably positioned in said sleeve.

7. A device as in claim 1 wherein said support means comprises:

a spring having one end attached to said secured end of said respective restraint means and extending along said respective side edge to a second end of said spring;

a threaded rod with one end attached to said second spring end and another end extending along said respective side edge;

a bracket secured to said side edge and having a hole through which said threaded rod is located;

a wing nut screwed onto an end of said threaded rod on a side of said bracket distal from said spring.

8. A device as in claim 1 wherein said support means comprises:

a spring having one end attached to said secured end of said respective restraint means and extending along said side edge to a second end of said spring;

a rack having one end attached to said second end of said spring;

a bracket means secured to said side edge for slideably supporting said rack;

a pinion gear supported on said side edge and engaging said rack;

means for rotating said pinion gear.

9. A device as in claim 8 wherein said rack and pinion are replaced by a worm screw drive.

10. A device as in claim 1 wherein said restraint means comprises a rigid cross member having two bowed ends and said securing means comprises a threaded rod having one end secured to said seat and extending away from said front edge through said hole with a nut screwed onto said threaded rod on a side of said cross member distal from said front edge.

11. A chair for supporting a user, said user having a back and knees, comprising:

a substantially rectangular seat means for supporting said user and having two side edges and a front edge and a back edge thereby forming two front corners and two back corners;

a back rest having a bottom edge secured to said back edge of said seat;

support means for supporting said seat;

a pair of restraint means, each having a secured end and a bow shaped end for engaging a front of one of said user's knees, a pair of restraint bars, one said restraint bar slideably attached substantially parallel to one of said seat sides respectively and having a rear end proximal to one of said back corners and a restraining end adjacent to one of said front corners respectively;

each said restraining end curved around one of said front corners respectively and adjustably positioned at a space from said front edge such that said user may sit in said seat means with a knee in one of said spaces respectively providing that said knees are restrained by said restraining ends with the back of said user simultaneously supported by said back of said chair;

support means for adjustably securing said secured ends of said restraint means to said chair and each said restraint means and said respective securing means constructed in operable combination with one another to provide that a user sitting in said chair with the knees restrained by said restraint means be permitted to position the knees relative to said front edge by adjusting said support means in a location where said user's back is supported against said back of said chair thereby preventing slump.

12. A chair as in claim 11 wherein said support means are a pair of supports adjustably attached to said side edges of said seat.

13. A chair as in claim 11 wherein said seat support means comprises chair legs.

14. A chair as in claim 11 wherein said seat support means comprises a swivel support.

15. A chair as in claim 11 wherein said restraint means are connected and are adjustably attached to said seat at the center thereof.

16. A chair as in claim 11 wherein;

each said restraint bar has an end proximal to one of said back corners respectively; and said securing means comprises a slide means for slideably attaching each said restraint bar to said seat means; and a means for securing said rear end of said restraining bar to said seat means thereby permitting said user to sit on said seat means with the knees in said spaces and slideably position said restraint bars to accommodate size and then secure each said restraint bar.

17. A chair as in claim 16 wherein said securing means comprises:

a pair of restraint brackets, one restraint bracket extending from one of said seat sides proximal to said back end and having a surface with a hole aligned with said restraint bar respectively;

a threaded rod parallel to one of said restraint bars and having one end attached to and extending away from said rear end of said restraint bar respectively and another end protruding through said aligned hole in said bracket; and a pair of nuts, one said nut on one of each said protruding ends of said threaded rods respectively.

18. A chair as in claim 16 which comprises a pair of springs, one said spring mounted on said protruding end of said threaded rod between said nut and said restraint bracket thereby springloading said restraint bar against said knee of said user, respectively.

19. A chair as in claim 11 wherein said seat means comprises:

a base having said side, front and back edges and to which said restraint brackets and slide means are attached;

a seat;

a pair of hinge brackets positioned along one side edge of said seat means and another pair of hinge brackets positioned along said other side edge of said seat means;

each said hinge bracket having a first end pivotally attached to said seat and another end pivotally attached to said base; and wherein said restraining means comprises:

a pair of restraint bars, one said restraint bar slideably attached substantially parallel to one of said base sides respectively and having a rear end proximal to one of said back comers and a restraining end adjacent to one of said front comers respectively;

each said restraining end curved around one of said front corners respectively and adjustably positioned at a space from said front edge such that said user may sit in said seat with a knee in one of said spaces respectively providing that said knees are restrained by said restraining ends with a back of said user supported by said back of said chair, a spring means between said seat and said base for biasing said seat away from said base; and each said hinge bracket arranged in operable combination with said other hinge brackets and said seat and said base such that when a user sits down on said seat, said seat is forced toward said front edge of said seat thereby forcing said user's knees against said restraint bars.

20. A chair as in claim 11 which comprises:

a base having said side, front and back edges and to which said brackets and slide means are attached;

a seat hingeably attached to said base proximal to said front edge;

a spring means between said seat and said base for biasing said seat in a direction of rotation away from said base;

wherein said restraining means comprises:

a pair of restraint bars, one said restraint bar slideably attached substantially parallel to one of said base sides respectively and having a rear end proximal to one of said back corners and a restraining end adjacent to one of said front comers respectively;

each said restraining end curved around one of said front corners respectively and adjustably positioned at a space from said front edge such that said user may sit in said seat with a knee in one of said spaces respectively providing that said knees are restrained by said restraining ends with a back of said user supported by said back of said chair; and a pair of cranks, one said crank pivotally attached to said base and including one arm with an end engaging said seat and another end engaging said rear end of said restraining bar, said crank constructed in operable combination with said seat, base and restraint bar respectively such that, when said user sits down on said seat, said restraint bars are pulled against said knees of said user.

* * * * *